US006857175B2

(12) United States Patent
Blöcher et al.

(10) Patent No.: US 6,857,175 B2
(45) Date of Patent: Feb. 22, 2005

(54) METHOD FOR RIVETING OR PIERCING AND A DEVICE FOR CARRYING OUT THE METHOD

(75) Inventors: Michael Blöcher, Biedenkopf (DE); Joachim Möser, Gruenberg (DE); Reinhold Opper, Alten-Buseck (DE)

(73) Assignee: Newfrey LLC, Newark, DE (US)

( * ) Notice: Subject to any disclaimer, the term of this patent is extended or adjusted under 35 U.S.C. 154(b) by 353 days.

(21) Appl. No.: 10/042,623

(22) Filed: Jan. 9, 2002

(65) Prior Publication Data

US 2002/0092145 A1 Jul. 18, 2002

(30) Foreign Application Priority Data

Jan. 15, 2001 (DE) ..... 101 01 724
Apr. 30, 2001 (DE) ..... 101 21 219

(51) Int. Cl.[7] ..... B23Q 17/00; B23P 21/00
(52) U.S. Cl. ..... 29/407.05; 29/715
(58) Field of Search ..... 29/407.05, 407.06, 29/407.09, 432, 505, 524.1, 525, 525.01, 525.05, 525.08, 715, 716, 718, 709, 712, 714

(56) References Cited

FOREIGN PATENT DOCUMENTS

JP 62179825 * 8/1987

* cited by examiner

*Primary Examiner*—John C. Hong
(74) *Attorney, Agent, or Firm*—Miles & Stockbridge P.C.

(57) ABSTRACT

The method according to the invention for riveting, or self-piercing, by means of a riveting or self-piercing device (8), having a male die (3) guided by a pick-up device (4), both of which in each case can be moved towards a female die (5) and/or a workpiece (6), wherein the female die (5) and riveting or self-piercing device (8) will be connected to one another via a counterforce structure (9). The relative movement between the pick-up device (4) and the counterforce structure (9) is measured by a first sensor (1), and the relative movement between counterforce structure (9) and male die (3) is measured by a second sensor (2). The depth of the riveting or piercing is adjusted with the aid of the two measured values. The associated device allows fast, accurate detection of the thickness of a workpiece (6) and precise piercing or riveting with constant predetermined depth irrespective of variations in the quality of the material or other parameters, which can result in deformations of the counterforce structure (9) during the piercing process.

24 Claims, 1 Drawing Sheet

METHOD FOR RIVETING OR PIERCING AND A DEVICE FOR CARRYING OUT THE METHOD

BACKGROUND OF THE INVENTION

Figure 1:
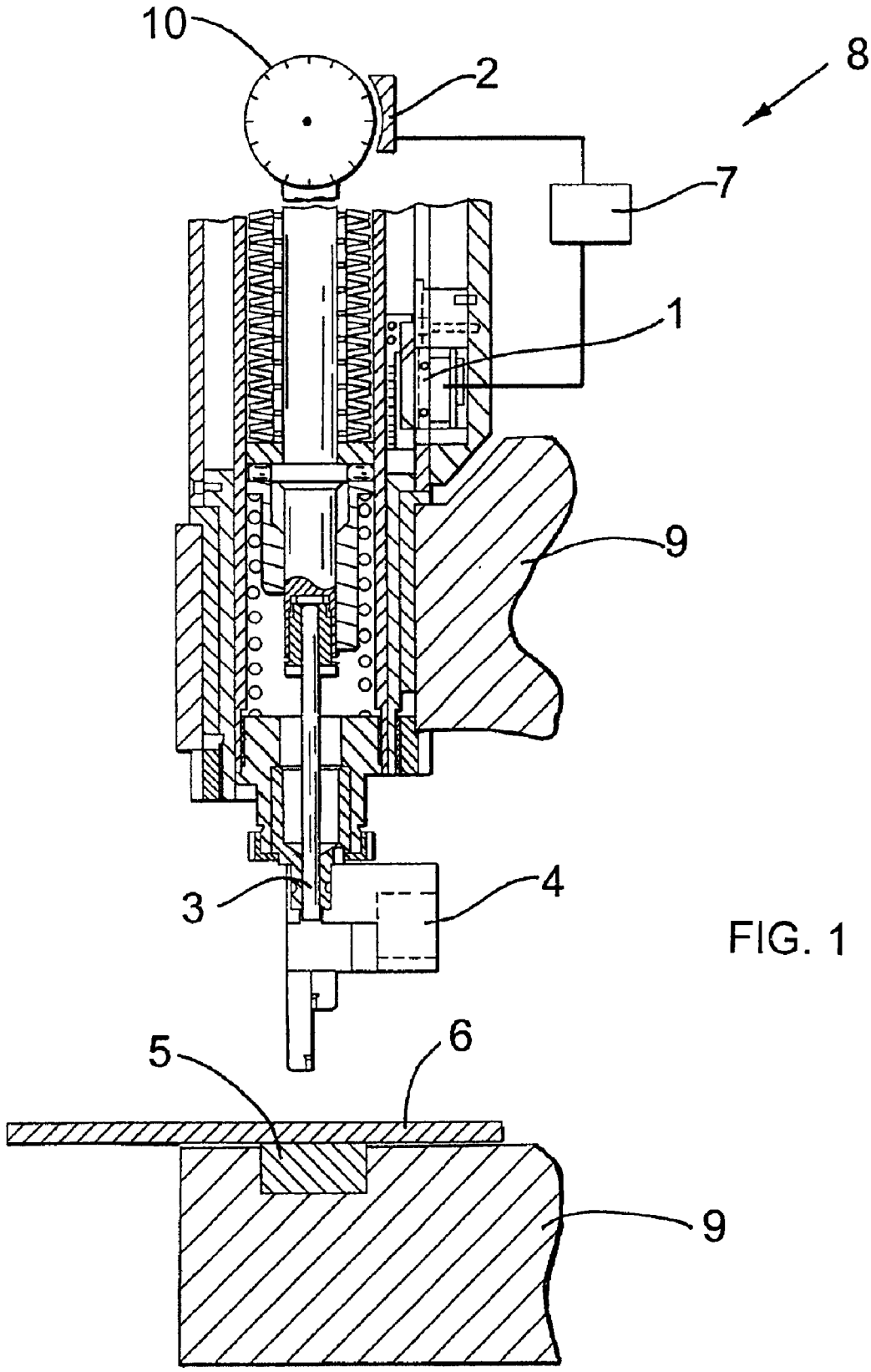

The present invention relates to a method for riveting, or self-piercing, and a device for carrying out the method. The large forces on a workpiece which occur when a rivet is set or during piercing must be compensated by a counterforce. This is usually achieved by supporting the workpiece on a counterforce structure, which preferably substantially has the shape of a C and is therefore also usually designated as a C-bracket.

For the precise setting of a rivet or accurate self-piercing it is important to know how deeply a rivet or a die has penetrated into the workpiece. This problem arises in particular when large workpieces are being processed, where the counterforce structure (C-bracket) is very large. In practice arm lengths of C-brackets occur of up to 1.5 metres. Deformation of the counterforce structure occurs in particular with large forces acting on the workpiece, so the actual self-piercing depth or the rivet head projection is determined only inaccurately. This problem is particularly significant when short rivets, hard materials and large workpieces are used. Distortion of the counterforce structure results in considerable inaccuracies with respect to the piercing depth or the rivet head projection.

To date it has been usual to construct the counterforce structure as large and as resistant to bending as possible. To keep deformation within an acceptable scope considerable expenditure and costs in the construction of the counterforce brackets have been necessary. Compensation of any deformations of the counterforce bracket took place manually, after the fault had been detected empirically.

SUMMARY OF THE INVENTION

It is the object of the present invention to disclose a method for riveting, or self-piercing, which overcomes the disadvantages of the prior art and to allow the setting or piercing process to run particularly accurately, as well as to describe a device for carrying out the method.

In the method for riveting or piercing with a counterforce bracket according to the invention the deformation of the counterforce structure during a riveting or piercing process is detected by a monitoring unit and a course of movement during the riveting or piercing process is corrected as a function of the bending. Detection of the deformation of the counterforce structure, which can vary according to the piercing or setting force, the materials used, the rivets used and other parameters specific to material or shape, as different forces occur, allows flexible adaptation to every operational situation. The position of the rivet head is precisely achieved by correcting the course of movement during the riveting or piercing process as a function of the bending. The inaccuracies during the riveting or piercing process due to the deformation of the counterforce structure are compensated in certain limits. An advantageous consequence of this method can even be that counterforce structures can be used which have less stiffness or higher deformability, so they can be more simply constructed and therefore production costs can be saved.

Typically a setting device has a die plate, a pick-up device and a die guided in the pick-up device, which presses directly or indirectly on a workpiece, located between die plate and pick-up device. When the pick-up device makes contact with the workpiece the riveting depth can be determined from the relative movement between pick-up device and die. A disadvantage of this, however, is that the cable ducts needed for detecting the relative movement between die and pick-up device suffer from the constant movement both of the pick-up device and of the die in long-term operation and in time are subjected to wear phenomena.

In a preferred configuration of the method according to the invention the relative movement between pick-up device and counterforce structure is detected by a first sensor, and the relative movement between pick-up device and die and between die and counterforce structure is detected by a second sensor. Responsive to this, the depth of the riveting or piercing is adjusted with the aid of the two measured values. The two sensors are preferably constructed as path sensors, in particular digital step counters. It is important herein that not only the relative displacement between pick-up device and die is detected, but additionally also the movement of the pick-up device due to deformations of the counterforce structure.

According to an advantageous further development of the method the setting of the die and the pick-up device on the die plate or on a workpiece is detected by a measurement of the force on the drive of the die. By measuring a reference position at a defined force when the die and/or the pick-up device are set, calibration can be performed in a simple manner. The measurement of the force takes place via the housing, so the forces exerted by the die and the holding-down clamp are measured together. With this information the actual depth of the riveting or piercing, and also the length of the riveting can then be accurately determined. These reference measurements can also be used to determine the thickness of workpieces accurately and quickly. The relative displacement between die and pick-up device at the deepest point corresponds exactly to the pressing depth or the rivet head projection.

The method according to the invention in a preferred embodiment has the effect that a predetermined movement path of the die towards the workpiece, based on a desired piercing depth or a desired rivet head projection, is lengthened by the relative movement between counterforce structure and pick-up device measured by the first sensor during the riveting or piercing process. With different hardness of the material to be processed, but also even with different temperatures, etc., the forces occurring during riveting or self-piercing are different, leading to deformations of the counterforce structure which cannot be accurately determined empirically. By means of the compensation according to the invention with the relative movement measured by the first sensor, which exactly corresponds to the deformation of the counterforce structure, a constant setting or self-piercing depth can nevertheless be achieved.

In addition, however, the measurement of the deformation of the counterforce structure can also provide further valuable information, in other words, for example, on the quality of the material to be processed, the state of the counterforce structure, the quality of the process carried out itself, etc. This is another substantial advantage of the invention.

A riveting or piercing device according to the invention, in particular for carrying out the above method, has a pick-up device and a die guided by the pick-up device, which in each case can be moved towards a die plate or a workpiece, wherein die plate and riveting or piercing device are connected to one another via a counterforce structure, in particular a C-shaped counterforce bracket. In that a first sensor is present which measures the relative movement between pick-up device and counterforce structure and a second sensor is present which measures the relative movement between pick-up device and die or between die and counterforce structure, an exact detection of the actual position of the die relative to the die plate or the workpiece is possible. Deviations from the target position can for the first time be corrected by adjusting during the course of movement and no longer have to be manually input based on empirical observations.

Preferably the first path recorder is a linear path recorder, preferably a digital counter, which, for example, counts stroke-shaped markings on a kind of ruler. This enables fast and accurate processing of the signals in a monitoring unit.

BRIEF DESCRIPTION OF THE ACCOMPANYING DRAWINGS

Further special configurations and advantages of the invention are explained in the following drawing using a rivet setting, or self-piercing, machine.

FIG. 1 is a side elevational view, partly in section, of a rivet setting or piercing machine of the preferred embodiment of the present invention.

DETAILED DESCRIPTION OF THE PREFERRED EMBODIMENTS

FIG. 1 shows a riveting device 8, but a self-piercing machine (not shown) could have been illustrated to show the present invention. The riveting device 8 has a counterforce structure 9 surrounding a workpiece 6 in the form of a C-shaped bracket of which only the outer portions are shown. The workpiece 6 is supported on a die plate 5. A pick-up device 4 picks up rivets, which are driven into the workpiece 6 with the aid of a die 3 driven by a drive unit 10. A first sensor 1 measures the relative movement between pick-up device 4 and counterforce structure 9. This sensor is preferably a linear path recorder consisting of a kind of ruler which makes the same movement as the pick-up device 4 and a counter which is fixed to the counterforce structure 9 and counts markings on the ruler going past it. A second sensor 2 measures the relative movement between counterforce structure 9 and die 3. Sensors of this kind are known per se and usually integrated into the drive unit 10 of the die 3. With spindle drives they are, for example, step counters. The first sensor 1 and the second sensor 2 are connected to a monitoring unit 7, which can thereby detect the bending of the counterforce structure 9 during action of the force exerted by the die 3 and the pick-up device 4 on the workpiece 6. With the knowledge of the bending of the counterforce structure 9 detected in this way the movement of the die 3 can be adjusted in such a way that a constant penetration depth of the rivets is always ensured. Owing to the correction, the counterforce bracket 9 can possibly be constructed as even lighter, smaller and more economical.

The method for riveting or piercing, in which the deformation of the counterforce structure 9 during a riveting or piercing process is detected by a monitoring unit 7 and a course of movement during the riveting or piercing process is corrected as a function of the bending, is particularly suitable for guaranteeing particularly good reproducibility of the setting depth or of the rivet head projection and therein gaining additional information on the working process.

It will also be appreciated that the above-described invention may be embodied in other specific forms without departing from the spirit or essential characteristics thereof. The present embodiments are, therefore, to be considered in all aspects as illustrative and not restrictive, the scope of the invention being indicated by the appended claims rather than by the foregoing description, and all changes which come within the meaning and range of equivalency are, therefore, intended to be embraced therein.

What is claimed is:

1. A method of operating on a workpiece (6) carried on a female die (5) mounted on one end of a C-shaped counterforce structure (9) and on which is mounted, at the other end thereof, a device (8) having a pick-up device (4), and a male die (3) guided by the pick-up device (4), the method comprises the steps of:

a. measuring relative movement between the counterforce structure (9) and the pick-up device (4) with a first sensor (1);

b. measuring relative movement between the pick-up device (4) and the male die (3) with a second sensor (2); and c. setting a uniform depth of operation on the workpiece (6) responsive to the measurements of the first sensor (1) and the second sensor (2).

2. The method claimed in claim 1 with the additional step of:

a. calibrating the setting of the male die (3) responsive to the measurements of the first sensor (1) and the second sensor (2), each of which has recorded a reference value.

3. The method claimed in claim 2 with the additional steps of:

a. measuring the movement between the counterforce structure (9) and the pick-up device (4) by the first sensor (1) during the operation on the workpiece (6); and b. controlling the movement of the male die (3) responsive to the measured movement to set a rivet head projection in the workpiece (6).

4. The method claimed in claim 3 with the additional step of:

a. recording measured deformation of the counterforce structure as a quality signal of any one of a selective quality of the counterforce structure (9), the nature of the workpiece (6), the rivets and the male and the female dies (3 and 5), and a process of the operation.

5. A method of riveting a workpiece (6) carried on one end of a C-shaped counterforce structure (9) above a female die (5) mounted in the counterforce structure (9), and on the other end of which a device (8) is connected, the device (8) has a pick-up device (4) and a male die (3) guided by the pick-up device (4) and to co-act with the female die (5), the method comprising the steps of:

a. applying a force on the workpiece (6);

b. measuring relative movement between the counterforce structure (9) and the pick-up device (4) with a first sensor (1);

c. measuring a single relative movement, selectively, between the pick-up device (4) and the male die (3), and the male die (3) and the counterforce structure (9) with a second sensor (2); and d. adjusting the depth of the riveting to a predetermined value responsive to the measured values of the first sensor (1) and the second sensor (2).

6. The method claimed in claim 5 with the additional step of:

a. calibrating setting of the male die (3) responsive to the measurements of the first sensor (1) and the second sensor (2), each of which has recorded a reference value.

7. A method of riveting a workpiece (6) with a rivet having a rivet head that projects upwardly from the workpiece (6) that is carried on one end of a C-shaped counterforce structure (9) above a female die (5) mounted in the counterforce structure (9) and on the other end of which a device (8) is connected, the device (8) has a pick-up device (4) and a male die (3) guided by the pick-up device (4) and to co-act with the female die (5), the method comprising the steps of:

a. applying a force on the workpiece (6);

b. measuring relative movement between the counterforce structure (9) and the pick-up device (4) with a first sensor (1);

c. measuring a single relative movement, selectively, between the pick-up device (4) and the male die (3), and the male die (3) and the counterforce structure (9) with a second sensor (2); and d. adjusting the height of the projection of the rivet head to a predetermined value responsive to measured values of the first sensor (1) and the second sensor (2).

8. The method claimed in claim 7 with the additional step of:

a. calibrating the setting of the male die (3) responsive to the measurement of the first sensor (1) and the second sensor (2), each of which has recorded a reference value.

9. The method claimed in claim 8 with the additional steps of:

a. measuring the movement between the counterforce structure (9) and the pick-up device (4) by the first sensor (1) during the riveting of the workpiece (6); and b. controlling movement of the male die (3) responsive to the measured movement to set a rivet head projection in the workpiece (6).

10. The method claimed in claim 9 with the additional step of:

a. recording measured deformation of the counterforce structure (9) as a quality signal of any one of a selective quality of the counterforce structure (9), the nature of the workpiece, the rivets and the male and the female dies (3 and 5) and a process of the operation.

11. A combination wherein an operating device (8) is mounted on one end of a C-shaped counterforce structure (9) on which the other end has mounted thereon a female die (5) which carries a workpiece (6), and comprising:

a. a pick-up device (4) moveable in a direction of the female die (5);

b. a male die (3) guided by the pick-up device (4) to be moveable in the direction of the female die (5);

c. a first sensor (1) to measure relative movement between the pick-up device (4) and the counterforce structure (9); and d. a second sensor (2) selectively to measure relative movement between the pick-up device (4) and the male die (3) and between the male die (3) and the counterforce structure (9).

12. The combination claimed in claim 11 wherein:

a. the first sensor (1) defines a digital counter.

13. The combination claimed in claim 12 wherein:

a. a monitoring unit (7) measures values of the first sensor (1) and the second sensor (2) to calculate and record deformation of the counterforce structure (9) from the measured values of the first sensor (1) and the second sensor (2).

14. A combination wherein a riveting device (8) is mounted on one end of a C-shaped counterforce structure (9) on which the other end has mounted thereon a female die (5) which carries a workpiece (6), and comprising:

a. a pick-up device (4) moveable in a direction of the female die (5);

b. a male die (3) guided by the pick-up device (4) to be moveable in the direction of the female die (5);

c. a first sensor (1) to measure relative movement between the pick-up device (4) and the counterforce structure (9); and d. a second sensor (2) selectively to measure relative movement between the pick-up device (4) and the male die (3) and between the male die (3) and the counterforce structure (9).

15. The combination claimed in claim 14 wherein:

a. the first sensor (1) defines a digital counter.

16. The combination claimed in claim 15 wherein:

a. a monitoring unit (7) measures values of the first sensor (1) and the second sensor (2) to calculate and record deformation of the counterforce structure (9) from the measured values of the first sensor (1) and the second sensor (2).

17. A combination wherein a piercing device (8) is mounted on one end of a C-shaped counterforce structure (9) on which the other end has mounted thereon a female die (5) which carries a workpiece (6), and comprising:

a. a pick-up device (4) moveable in a direction of the female die (5);

b. a male die (3) guided by the pick-up device (4) to be moveable in the direction of the female die (5);

c. a first sensor (1) to measure relative movement between the pick-up device (4) and the counterforce structure (9); and d. a second sensor (2) selectively to measure relative movement between the pick-up device (4) and the male die (3) and between the male die (3) and the counterforce structure (9).

18. The combination claimed in claim 17 wherein:

a. the first sensor (1) defines a digital counter.

19. The combination claimed in claim 18 wherein:

a. a monitoring unit (7) measures values of the first sensor (1) and the second sensor (2) to calculate and record deformation of the counterforce structure (9) from the measured values of the first sensor (1) and the second sensor (2).

20. A combination wherein a self-piercing device (8) is mounted on one end of a C-shaped counterforce structure (9) on which the other end has mounted thereon a female die (5) which carries a workpiece (6), and comprising:

a. a pick-up device (4) moveable in a direction of the female die (5);

b. a male die (3) guided by the pick-up device (4) to be moveable in the direction of the female die (5);

c. a first sensor (1) to measure relative movement between the pick-up device (4) and the counterforce structure (9); and d. a second sensor (2) selectively to measure relative movement between the pick-up device (4) and the male die (3) and between the male die (3) and the counterforce structure (9).

21. The combination claimed in claim 20 wherein:

a. the first sensor (1) defines a digital counter.

22. The combination claimed in claim 21 wherein;

a. a monitoring unit (7) measures values of the first sensor (1) and the second sensor (2) to calculate and record deformation of the counterforce structure (9) from the measured values of the first sensor (1) and the second sensor (2).

23. A method of piercing a workpiece (6) carried on a C-shaped counterforce structure (9) comprising the steps of:

a. deforming a C-shaped counterforce structure (9) with a sufficiently large force, while the counterforce structure (9) carries the workpiece (6);

b. measuring the deformation of the C-shaped counterforce structure; and c. correcting the force of the piercing to a predetermined amount to produce a uniform result responsive to the extent of the deformation, wherein movement between the counterforce structure (9) and a pickup device (4) by a first sensor (1) during the piercing of the workpiece (6) is measured, and movement of a male die (3) is controlled responsive to the measured movement to set a rivet head projection in the workpiece (6).

24. The method claimed in claim 23, with the additional step of:

a. recording the measured deformation of the counterforce structure (9) as a quality signal of any one of a selective quality of the counterforce structure (9), the nature of the workpiece (6), rivets and the male and female dies (3 and 5), and a process of the piercing.

* * * * *